US005342548A

United States Patent [19]

Yorke et al.

[11] Patent Number: 5,342,548

[45] Date of Patent: Aug. 30, 1994

[54] METHODS FOR INHIBITING THE CORROSION AND DEPOSITION OF IRON AND IRON-CONTAINING METALS IN AQUEOUS SYSTEMS

[75] Inventors: William J. Yorke, Newtown; Edmund J. Bockowski, Furlong, both of Pa.

[73] Assignee: Betz Laboratories, Inc., Trevose, Pa.

[21] Appl. No.: 125,999

[22] Filed: Sep. 23, 1993

[51] Int. Cl.[5] ..... C23F 11/00

[52] U.S. Cl. ..... 252/391; 252/389.62; 252/389.2; 544/219; 422/15; 422/16; 106/14.12; 106/14.16

[58] Field of Search ..... 252/391, 389.62, 394, 252/395, 389.2, 389.23, 389.24; 544/219; 106/14.16, 14.12; 422/15, 16

[56] References Cited

U.S. PATENT DOCUMENTS

| | | | |
|---|---|---|---|
| 3,723,428 | 3/1973 | Song | 544/219 |
| 3,887,516 | 6/1975 | Song | 524/100 |
| 4,165,435 | 8/1979 | Hiestand et al. | 544/219 |
| 4,173,694 | 11/1979 | Inagami | 525/351 |
| 4,234,341 | 11/1980 | Hiestand et al. | 106/18.22 |
| 4,329,381 | 5/1982 | Eschwey et al. | 427/386 |
| 4,338,209 | 7/1982 | Manabe et al. | 252/391 |
| 4,357,396 | 11/1982 | Grunewalder et al. | 252/391 |
| 4,450,137 | 5/1984 | Thompson et al. | 252/391 |
| 4,849,517 | 7/1989 | Weber et al. | 544/219 |
| 4,906,751 | 3/1990 | Schneider | 544/218 |
| 5,006,654 | 4/1991 | Ludwig et al. | 544/219 |

FOREIGN PATENT DOCUMENTS

| | | | |
|---|---|---|---|
| 0041309 | 12/1981 | European Pat. Off. | 252/391 |
| 0462666 | 12/1991 | European Pat. Off. | 252/391 |
| 0462809 | 12/1991 | European Pat. Off. | 252/391 |

*Primary Examiner*—Anthony Green

*Attorney, Agent, or Firm*—Alexander D. Ricci; Philip H. Von Neida

[57] ABSTRACT

Methods are provided for inhibiting the corrosion of iron and iron-containing methods in contact with aqueous systems. Trisodium salt of 2,4,6-trimercapto-5-triazine is added to cooling water systems to inhibit the corrosion of these metal surfaces.

4 Claims, No Drawings

METHODS FOR INHIBITING THE CORROSION AND DEPOSITION OF IRON AND IRON-CONTAINING METALS IN AQUEOUS SYSTEMS

FIELD OF THE INVENTION

The present invention pertains to methods for inhibiting the corrosion of iron and iron-containing metals in industrial cooling water systems.

BACKGROUND OF THE INVENTION

In many industrial processes, undesirable excess heat is removed by the use of heat exchangers in which water is used as the heat exchange fluid. The term "cooling water" is applied wherever water is circulated through equipment to absorb and carry away heat. This definition includes air conditioning systems, engine jacket systems, refrigeration systems as well as the multitude of industrial heat exchange operations, such as found in oil refineries, chemical plants, steel mills, etc.

The use of a recirculating system, in which a cooling tower, spray pond, evaporative condenser and the like serve to dissipate heat, permits great economy in makeup water requirements. In a cooling water system employing a cooling tower, water is circulated through the heat transfer equipment and subsequently cooled by evaporation of a part of the circulating water as the water is passed over the cooling tower. By virtue of the evaporation which takes place in cooling, the dissolved solids and suspended solids in the water become concentrated. The circulating water becomes more concentrated than the makeup water due to this evaporation loss.

"Cycles of concentration" is the phrase employed to indicate the degree of concentration of the circulating water as compared with the makeup. For example, 2.0 cycles of concentration indicates the circulating water is twice the concentration of the makeup water. To maintain the circulating water at some given cycles of concentration, a portion of the circular water must be physically removed from the system and replaced with fresh makeup water to maintain a steady-state condition. The circulating water removed from the system is referred to as "blowdown".

Preventing the corrosion of industrial heat transfer equipment is essential to the efficient and economical operation of a cooling system. Excessive corrosion of metallic surfaces can cause the premature failure of process equipment, necessitating downtime for the replacement or repair of the equipment.

Additionally, the buildup of corrosion products on heat transfer surfaces impedes water flow and reduces heat transfer efficiency, thereby limiting production or requiring down time for cleaning, and can also cause rapid localized corrosion and subsequent penetration of metallic surfaces through the formation of differential oxygen concentration cells. The localized corrosion resulting from differential oxygen cells originating from deposits is commonly referred to as "under-deposit corrosion". "Galvanic corrosion" can also occur if the corrosion products include metals different from that of the metal surface.

With the advent of strict Federal, State and Municipal Environmental controls and water shortages throughout the country, recirculating cooling water systems were, in many cases, forced to operate at higher cycles of concentration to reduce both water consumption and the volume of blowdown from the system. As the cycles of concentration increase, corrosion problems become more severe because of the higher dissolved salt concentrations that are encountered. Higher cycles will also increase the concentration of corrosive agents that are not present in the makeup water, but are introduced during the course of the cooling operation. These may include, for example, hypochlorite ions added for their biocidal action, sulfide ions present through process leaks, sulfate or chloride ions added as their hydrogen acids to control pH, or corrosion products that are dissolved, dispersed or redeposited throughout the system.

SUMMARY OF THE INVENTION

The present invention relates to methods for inhibiting the corrosion of iron containing metals in contact with cooling waters. The methods comprise adding a sufficient amount of 2,4,6-trimercapto-s-triazine trisodium salt (TMT) to the cooling water sought to be treated.

DESCRIPTION OF THE RELATED ART

Protective coatings for metal surfaces are taught in U.S. Pat. No. 4,329,381. The improvement being adding to conventional coatings a lead or zinc salt of five or six membered heterocyclic compounds substituted by at least one hydroxyl or mercapto group and at least one nitrogen atom and two conjugated double bonds in the ring.

U.S. Pat. No. 4,906,751 teaches mercapto-triazine derivatives useful in lubricants, hydraulic fluids and metal-working fluids as anti wear and anticorrosion additives. U.S. Pat. No. 4,173,694 teaches a polychloroprene rubber composition utilizing a di or tri-mercapto-3-triazine vulcanizing agent.

DETAILED DESCRIPTION OF THE INVENTION

Disclosed are methods for inhibiting the corrosion of iron containing metals in contact with cooling water systems comprising adding to said cooling water systems a corrosion inhibiting amount of trisodium salt of 2,4,6-trimercapto-s-triazine.

Cooling water systems often experience adverse conditions. These adverse conditions contribute to the corrosion of the iron containing metallurgies. The present invention is effective at inhibiting corrosion in cooling waters when oxidizing biocides, corrosion by-products such as copper and sulfide leaks are present. Long retention times can also contribute to iron containing metal corrosion.

The total amount of the trisodium salt of 2,4,6-trimercapto-s-triazine (TMT) used in the methods of the present invention is that amount which is sufficient to inhibit corrosion in the cooling water system and will vary according to the conditions in the cooling water system. Higher biocide, copper and sulfide concentrations and longer retention times will require larger amounts of TMT to be added to the cooling water system.

TMT can be added to the cooling water system in an amount ranging from about 0.1 to about 50 parts per million parts water. The preferred dosage is from about 3 to about 10 parts per million parts water.

Other corrosion inhibitors and dispersants may be used in combination with the TMT. These methods may also be applied with other water treatment agents, such as microbiological control species like oxidizing and nonoxidizing biocides.

One advantage of the present invention is that it is capable of maintaining low iron metal corrosion rates under aggressive conditions that occur when both an oxidizing biocide, such as hypochlorite, and sulfide ions are present in the cooling water system at the same time.

The TMT can be added to the cooling water system by any conventional manner. Preferably this compound is added as an aqueous solution. The addition of this solution may be either intermittent or continuous.

The data set forth below illustrate this invention. These examples are only illustrations and should not be construed as limiting the scope thereof.

All tests were carried out in a recirculator containing both low carbon steel and Admiralty brass metallurgy, in which the temperature was kept at 120° F. and the pH was actively controlled at 7.2. Results are reported as straight-line corrosion rates expressed as mils per year, on pairs of low carbon steel coupons.

The following water composition was used.

| | |
|---|---|
| calcium | 500 ppm as $CaCO_3$ |
| magnesium | 250 ppm as $CaCO_3$ |
| chloride | 354 ppm as Cl |
| sulfate | 240 ppm as $SO_4$ |
| orthophosphate | 15 ppm as $PO_4$ |
| pyrophosphate | 3 ppm as $PO_4$ |
| 1-hydroxyethylidene-1, 1-diphosphonic acid | 2.4 ppm as $PO_4$ |
| polymer dispersant | 6 ppm as active polymer |
| tolytriazole | 3 ppm as tolytriazole |

EXAMPLE 1

The adverse conditions of combined sulfide and chlorination were simulated by the continual feed of both a 0.1% (as $H_2S$) aqueous solution of sodium sulfide at the rate of 0.8 ml per hour, and a 0.9% aqueous solution of sodium hypochlorite at the rate of 1.2 ml per hour, into the 11 liter system. TMT was present at 6 ppm. The duration of exposure of the coupons was 6 days. These results are presented in Table I.

TABLE I

| Run No. | TMT Level (ppm) | LCS ics-1 (mpy) | LCS ics-2 (mpy) |
|---|---|---|---|
| 207 | — | 9.4 | 11.7 |
| 519 | 2 | 5.8 | 6.7 |
| 520 | 6 | 1.9 | 1.7 |

TMT = Trisodium salt of 2,4,6-trimercaplo-S-triazine
LCS = low carbon steel

Under these conditions, improved corrosion rates were measured with TMT present when compared to results obtained under the same conditions without TMT. Further improvements in steel corrosion were measured when the TMT level was increased to 6 ppm.

EXAMPLE 2

The following test was performed under non-chlorinated conditions. The duration of the test was 1.7 days and performed in a 1.9 liter stirred beaker containing a mixed metallurgy of low carbon steel and admiralty brass. Treatment A had the same water composition as in Example 1 except no tolytriazole was present. Treatment B consists of 250 ppm Ca, 125 ppm Mg, 300 ppm Cl, 200 ppm $SO_4$, 7.5 ppm polymer, 6 ppm phosphonate, and 8 ppm orthophosphate. These corrosion testing results are presented in Table II.

TABLE II

| Treatment | TMT (ppm) | Weight Loss (mpy) | pH |
|---|---|---|---|
| A | 0 | 9.6 | 7.2 |
| A | 1 | 6.0 | 7.2 |
| A | 3 | 1.3 | 7.2 |
| B | 0 | 19 | 8.4 |
| B | 3 | 7.5 | 8.4 |
| B | 6 | 12 | 8.4 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A method for inhibiting the corrosion of iron and iron containing metal surfaces in contact with a cooling water system comprising adding a corrosion inhibiting amount of trisodium salt of 2,4,6-trimercapto-s-triazine (TMT) to said cooling water system.

2. The method as claimed in claim 1 wherein said TMT is added to said cooling water system in an amount ranging from about 0.1 to about 50 parts per mill ion parts cooling water.

3. The method as claimed in claim 1 wherein said TMT is added to said cooling water system with other corrosion inhibitors selected from the group consisting of orthophosphate, pyrophosphate and tolytriazole.

4. The method as claimed in claim 1 wherein said TMT is added to said cooling water system as an aqueous solution.

* * * * *